US005443254A

United States Patent [19]

Reist

[11] Patent Number: 5,443,254

[45] Date of Patent: Aug. 22, 1995

[54] ACTIVE INTERFACE FOR AN IMBRICATED STREAM OF PRINTED PRODUCTS

[75] Inventor: Walter Reist, Hinwil, Switzerland

[73] Assignee: Ferag AG, Hinwil, Switzerland

[21] Appl. No.: 53,918

[22] Filed: Apr. 27, 1993

[30] Foreign Application Priority Data

Apr. 27, 1992 [CH] Switzerland ..... 01325/92

[51] Int. Cl.[6] ..... B65H 29/66

[52] U.S. Cl. ..... 271/225; 271/275; 271/184; 271/186

[58] Field of Search ..... 271/150, 151, 186, 202, 271/216, 198, 270, 275, 225, 272, 184, 185; 198/407, 408

[56] References Cited

U.S. PATENT DOCUMENTS

| | | | |
|---|---|---|---|
| 1,883,889 | 10/1932 | Farley . | |
| 4,010,945 | 3/1977 | Kistner | 271/225 X |
| 5,054,767 | 10/1991 | Gammerler . | |

FOREIGN PATENT DOCUMENTS

| | | | |
|---|---|---|---|
| 0281887 | 9/1988 | European Pat. Off. . | |
| 2343675 | 10/1977 | France . | |
| 295370 | 12/1988 | Japan | 271/202 |
| 1559213 | 1/1980 | United Kingdom . | |
| 2121013 | 12/1983 | United Kingdom | 271/186 |

*Primary Examiner*—William E. Terrell
*Assistant Examiner*—Boris Milef
*Attorney, Agent, or Firm*—Bell, Seltzer, Park & Gibson

[57] ABSTRACT

The interface according to the invention for printed products conveyed in imbricated formation is used between an imbricated stream-delivering apparatus and an imbricated stream-receiving apparatus. The object of the interface is to change the stream parameters of the input stream ($S_i$) in such a way that an output stream ($S_o$) which meets the requirements of the downstream imbricated stream-receiving apparatus is produced from it. The interface has an input (I) for an input stream ($S_i$) and an output (O) for an output stream ($S_o$) and, between input and output, a serial arrangement of functional elements (UE, PE, RE). The interface has at least one deflecting element (UE) and at least one other functional element (PE, RE) and the serial arrangement is such that a deflecting element (UE) is always interposed between two other functional elements (PE, RE). The interface requires a minimum of transporting belts (41, 42, 45, 46), since each transporting belt running out from a functional element is the transporting belt running into the next functional element. In each functional element, the imbricated stream is set up with respect to speed, imbrication spacing and position of the printed products on the transporting belt for the next functional element.

9 Claims, 7 Drawing Sheets

$v_i \neq v_o \longrightarrow a_i \neq a_o$ $p_i = p_o$ oder $p_i \neq p_o$ $u_i \neq u_o$ $f_i \neq 0 \longrightarrow f_o = 0$ $\Delta a_i \neq \Delta a_o$ $\Delta l_i \neq \Delta l_o$ $\Delta p_i > \Delta p_o$ $p_i = p_o$ oder $p_i \neq p_o$ $\Delta p_i \geqslant \Delta p_o$ $u_i \neq u_o$ $\Delta l_i \not\longleftrightarrow \Delta l_o$ $f_o = 0$ $\Delta p_i = \Delta p_o$ $u_i \neq u_o$ $\Delta l_i \longleftrightarrow \Delta l_o$ $f_i = f_o$ $\Delta a_i = \Delta a_o$

ACTIVE INTERFACE FOR AN IMBRICATED STREAM OF PRINTED PRODUCTS

BRIEF SUMMARY OF THE INVENTION

The present invention pertains generally to processing printed products and, more specifically, to an interface for imbricated formations of printed products. The interface according to the invention is active, it handles an imbricated stream of printed products or other sheet-like articles and can be used between an apparatus which delivers an imbricated stream and an apparatus which further processes an imbricated stream or converts it into another transporting formation.

Imbricated streams of printed products are delivered, for example, by rotary presses, by unwinding stations from winders or by feeders from stacks. An imbricated stream is either further processed as such in a process station or it is first of all converted for further processing into another transporting formation, for example into a transporting stream, in which each printed product is transported in a suspended manner by means of a clip.

A delivered imbricated stream has particular properties, depending on the printed product and on the apparatus from which it is delivered. Each apparatus processing an imbricated stream or converting it into another transporting formation poses particular requirements on the properties of the fed imbricated stream. In order that imbricated stream-delivering and imbricated stream-receiving apparatuses can be combined as freely as possible, they must be configured or be able to be configured in such a way that in any event the delivered stream meets the requirements of further processing, or further apparatuses for adapting the imbricated stream must be interposed between imbricated stream-delivering apparatus and imbricated stream-receiving apparatus. The required configuration or suitability for configuration of the imbricated stream-delivering and imbricated stream-processing apparatuses either increases the number of necessary apparatus variants or makes the apparatuses more complex and consequently more expensive. The interposing of additional apparatuses requires considerable space, in particular if more than one additional apparatus is necessary.

It is thus the object of the invention to provide an interface which can be arranged between an imbricated stream-delivering apparatus and an imbricated stream-receiving apparatus. The interface is to be designed and active in such a way that it is flowed through by the imbricated stream and that the imbricated stream which runs out from the interface differs from the imbricated stream which runs into the interface, with respect to properties and/or with respect to quality. In other words this means that the imbricated stream is adapted by the interface for the imbricated stream-receiving apparatus. The interface is to be space-saving, simple and able to be used for as many applications as possible, that is to say it is to be able to change as many properties of an imbricated stream as possible within limits which are as broad as possible.

This object is achieved by the interface of the present invention. The operation and design of the interface according to the invention are to be described in detail with reference to the following figures.

BRIEF DESCRIPTION OF THE DRAWINGS

FIGS. 1*a* to 1*c* show two exemplary imbricated streams of printed products as a plan view (FIG. 1*a*) and as a side view (FIGS. 1*b* and 1*c*). One of the printed products (P) is emphasized as an example by hatching.

DETAILED DESCRIPTION

Figure 1A:
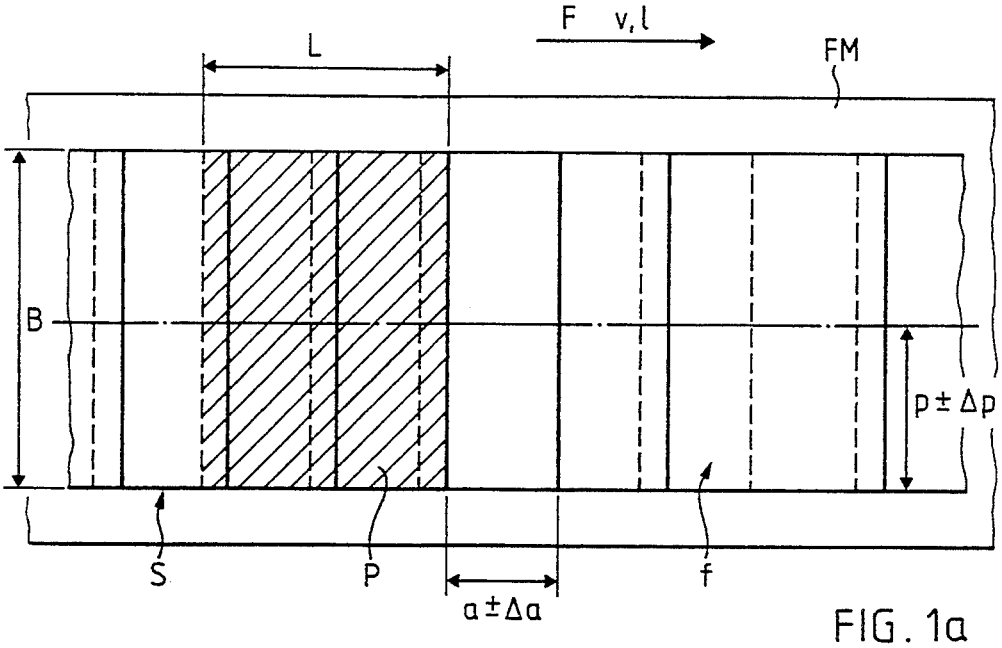
FIGS. 1*a* to 1*c* show two exemplary imbricated streams for representing the parameters characterizing an imbricated stream as a plan view (FIG. 1*a*) and as a side view (FIG. 1*c*) wherein one of the printed products (P) is exemplified by hatching.
Figure 1B:
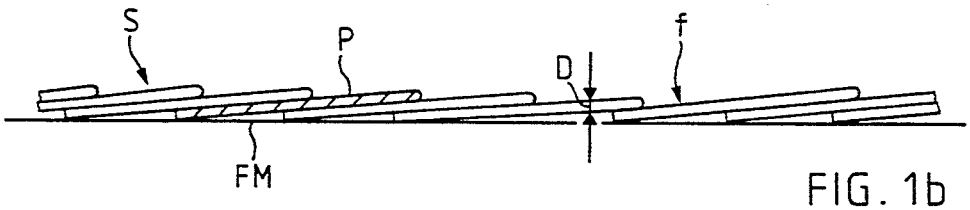
Figure 1C:
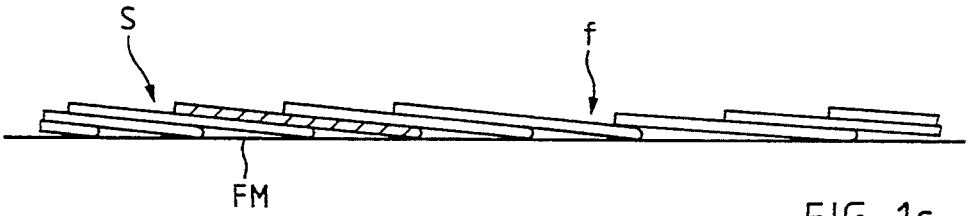

The imbricated streams is conveyed in conveying direction F on a moving conveying means FM, for example on a conveyor belt, on which the products rest overlapping one another freely or pressed in contact. The imbricated stream S is characterized by parameters which relate to each individual product (product parameters) and by parameters which relate to the movement of the products and to their relative arrangement in the stream (stream parameters). The product parameters are, in particular, length L, width B and thickness D of the products. The stream parameters, which relate to the movement of the products, are the stream speed v and the distance a between identical product edges of successive products, lying transversely to the conveying direction F, the quotient v/a representing the stream handling rate 1 in products per unit of time. The stream parameters, which relate to the relative position of the products in the stream, are the position p of the products on the conveying means (centrally, left-abutting of right-abutting or otherwise), the type of overlap u (leading edge on top, as shown in FIG. 1*b*, or leading edge underneath, as shown in FIG. 1*c*) and the orientation o of the products in relation to the conveying direction (for example fold at the front or fold at the rear).

In an ideal case, the said product and stream parameters (L, B, D, v, a, p, u, o) are constant over a production time. In reality, however, an imbricated stream is also characterized by irregularities, defects and time-related fluctuations occurring in it. In this respect, of primary importance for the present case are: irregularities $\Delta a$ in the product spacings, irregularities $\Delta p$ in the position of the products, defects, in particular gaps f and time-related fluctuations in the stream handling rate ($\Delta l = \Delta(v/a)$).

Figure 2:
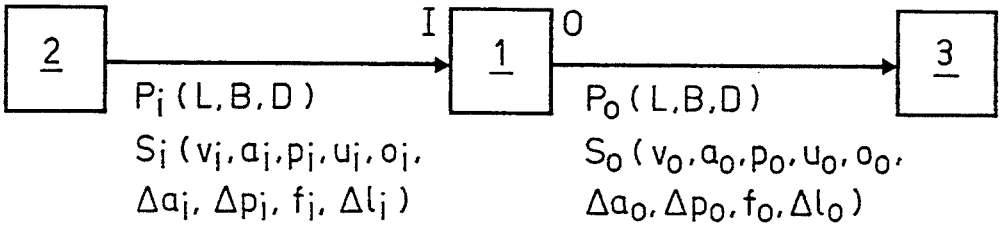
FIG. 2 shows a rough functional diagram of the interface according to the invention.

FIG. 2 then shows in a highly diagrammatic form an interface 1 according to the invention, which is arranged between an apparatus 2, which delivers an imbricated stream, and an apparatus 3, which processes an imbricated stream or converts it into another transporting formation. From the apparatus 2, printed products $P_i$ flow in the form of an imbricated stream $S_i$ (input stream) into an input I of the interface 1. From an output O of the interface 1, printed products $P_o$ flow in the form of an imbricated stream $S_o$ (output stream) into the apparatus 3.

The active interface according to the invention converts the input stream $S_i$ into the output stream $S_o$ by changing the stream parameters, that is to say by acting in an altering (a, p, u), uniformizing (Δa, Δp), correcting (f) and/or isolating (Δl) manner. The products flowing through the interface are not substantially changed during this ($P_i = P_o$). The only change to the products which the interface can effect is to apply pressure, by which for example folded products are changed slightly in the region of the fold. The active interface differs from a processing station in that it essentially changes only stream parameters, not product parameters.

Depending on the configuration of the interface, various stream parameters can be changed, it only being possible to change the parameters v and a, which are correlated by the stream handling rate, such that the handling rate l is substantially equal on average over time for input stream and output stream.

FIGS. 3*a* to 3*d* then diagrammatically show functional elements which the interface according to the invention may contain, with the stream parameters which can be changed by them.

Figure 3A:
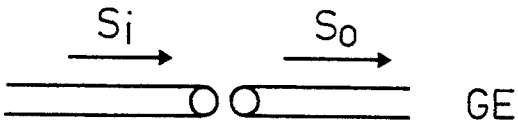
FIGS. 3*a* to 3*d* show the functional elements which an interface according to the invention can contain.

FIG. 3*a* shows as the basic functional element a simple transfer element GE, in which the imbricated stream is transferred from one transporting belt to another. If the speeds of the two transporting belts are not equal, the imbricated stream $S_i$ running into the transfer element differs from the out-running imbricated stream $S_o$ by a changed stream parameter a (product spacings), the stream handling rate $l = v/a$ remaining constant. Depending on the alignment of the two transporting belts with respect to each other, the stream parameter p (product position on the belt) also changes. The operation of a transfer element can be reversed, as desired.

Figure 3B:
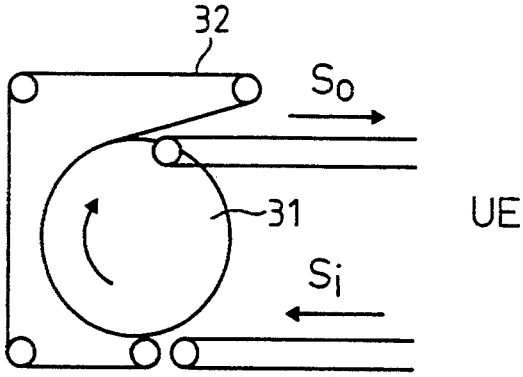
Figure 3C:
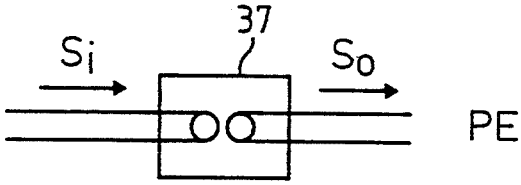
Figure 3D:
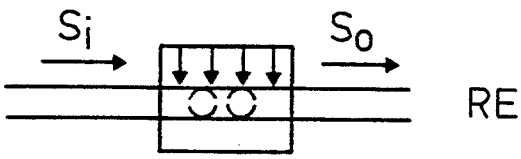

As FIGS. 3*b* to 3*d* show, the basic functional element GE (transfer element) is compulsorily contained in the actual functional elements or may be integrated therein.

FIG. 3*b* shows a deflecting element UE. The deflection produces from an in-running imbricated stream $S_i$ an out-running imbricated stream $S_o$, the two streams differing with respect to the stream parameter u in that, from a stream with leading edges lying on top, a stream with leading edges lying underneath (or vice versa) is produced.

In a known way, a deflecting element UE comprises, for example, a deflecting roller 31 and a deflecting belt 32, which runs around the deflecting roller. In the deflection, the printed products are passed between deflecting roller and deflecting belt. In addition to this there are two transporting belts, the in-running imbricated stream $S_i$ resting in the original position on one of them, the out-running imbricated stream $S_o$ resting in the turned-over position on the other. It is also conceivable for the deflecting element to have only one transporting belt, while the deflecting belt assumes the function of the other transporting belt.

Since in a deflecting element UE there always also takes place at least one transfer from a transporting belt to the deflecting belt and/or from the deflecting belt to a transporting belt, the deflecting element may additionally always assume the function of a transfer element as well, that is to say it may additionally act on the stream parameters v, a and p. The operation of a deflecting element is reversible, as desired.

An advantageous embodiment of a deflecting element UE for the interface according to the invention is described in connection with FIGS. 5*a* and 5*b*.

FIG. 3*c* shows a buffer element PE. This essentially comprises two transporting belts and a buffering means 37. As buffering means 37, use may be made of displacing means, by which the take-over point between the two transporting belts, which have different speeds, is locally displaced (lengthening of the transporting line at lower speed when filling the buffer), or stacking means, by which a stack of products is formed between the two transporting belts. A buffer element PE acts on the stream parameter f by closing gaps, and can act on the stream parameter Δa if the rate of the printed products is newly timed in the buffer element. Moreover, the buffer element PE acts as an isolating means with respect to handling rate fluctuations (Δl) between the input side and output side.

Since in the buffer element PE too the imbricated stream has to be transferred from one transporting belt to another, the buffer element can also assume the functions of a transfer element. The operation of a buffer element is not reversible.

Buffer elements which can be used in an interface according to the invention are known, for example, from the two Patents Nos. EP-0259650 and CH-667258 of the same applicant. Both cases concern buffer elements with a locally displaceable take-over point. A buffer element with stacking means is described in connection with FIG. 6.

FIG. 3*d* shows a righting element RE. In a righting element RE, the printed products are aligned transversely to the conveying direction with the aid of stops. The righting element acts in a uniformizing manner on the stream parameter p, that is to say it reduces the irregularities Δp. The stream parameter p is changed as a result. Depending on the arrangement and requirements, it is necessary to combine the righting element RE with a take-over element, as is indicated by dashed lines. In such cases, the righting element RE may at the same time serve as a take-over element GE for changing the stream parameters v, a and p. In a righting element with transfer function, the stream parameter p may be changed or retained.

Figure 7A:
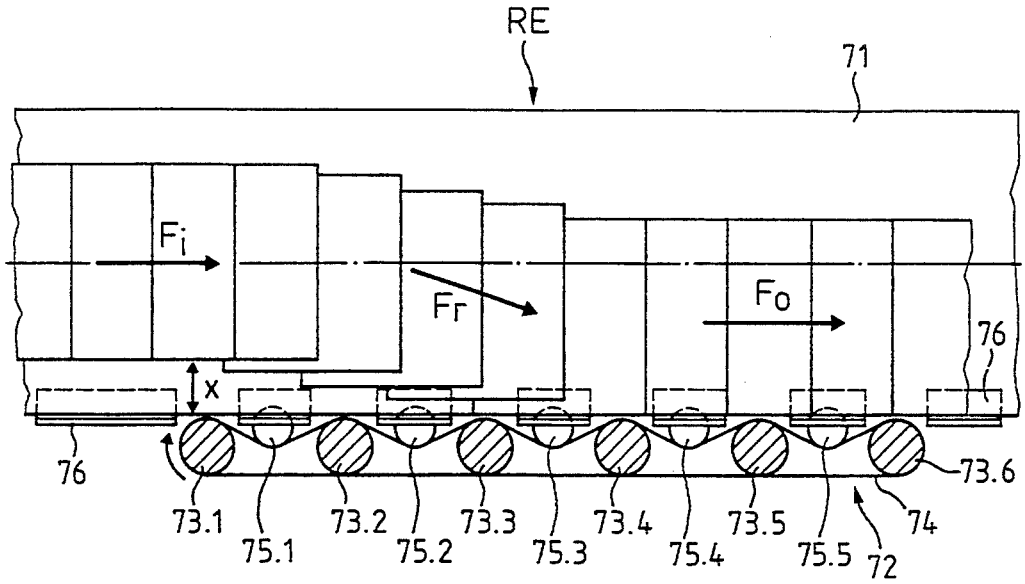
FIGS. 7*a* and *b* show an exemplary embodiment of the righting element as a plan view and a side view.
Figure 7B:
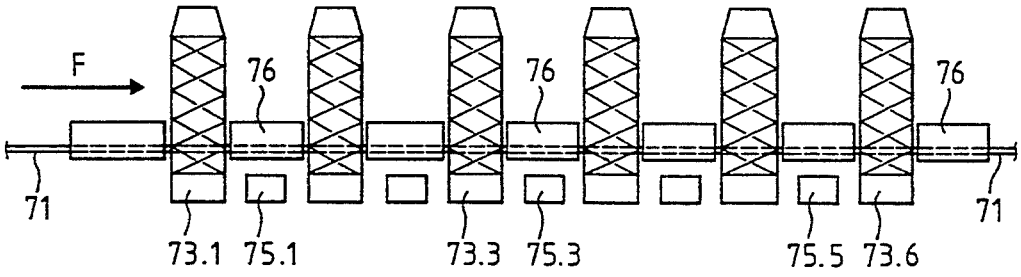

Righting elements are known, for example, from European Patent No. 0223941 of the same applicant. An embodiment advantageous for the interface according to the invention is described in connection with FIGS. 7*a* and *b*.

With the functional elements according to FIGS. 3*a* to 3*d*, all stream parameters apart from the orientation o of the products in the stream can be changed in keeping with the object for the-interface according to the invention. The interface according to the invention thus represents a serial arrangement of functional elements according to FIGS. 3*b* to 3*d* (UE, PE, RE) which is designed according to the following constructional principle: the number of transporting belts is as small as possible, by virtue of the fact that each transporting belt serves two elements, its beginning as an interface input or outlet from a functional element, its end as an inlet into a subsequent functional element or as an interface output. The functional elements are arranged as far as possible above one another and thereby in a space-saving manner. Functional elements which act only in a uniformizing manner (for example righting element) are arranged directly upstream of the interface output. The interface can be configured for different applications by setting or simple assembly.

Since the basic function (GE) is or can be integrated in each functional element (UE, PE, RE), the imbricated stream can be set up in each functional element for the following functional element with respect to the stream parameters v, a and p. For the first functional element, this setting is produced at the input of the interface, which forms a transfer element between the feeding transporting belt of the upstream apparatus and the first transporting belt of the interface. In the last functional unit, which comprises a transfer, the parameters v, a and p required at the output of the interface are set, so that the stream need not be changed any longer at the output of the interface, which in turn represents a transfer element. As a result, the quality of the stream is no longer impaired at the output, especially if it has been further improved by righting in a final functional element.

The arrangement of the functional elements one above the other is achieved by corresponding arrangement of deflecting elements. The interface according to the invention has at least one deflecting element. The sequence of the functional elements is such that deflecting elements (UE) alternate with other functional elements (PE, RE).

The suitability for configuration is realized by a plurality of inputs and outputs.

The interface according to the invention is distinguished furthermore by the fact that, according to the requirements on the imbricated stream of a particular application, various embodiments of the same functional elements can be used, which is equivalent to a further, more qualitative configuration.

The constructional principle on which the interface according to the invention is based results in an interface which can be configured in a standardized way and nevertheless is very compact and very capable of high handling rates.

Figure 4A:
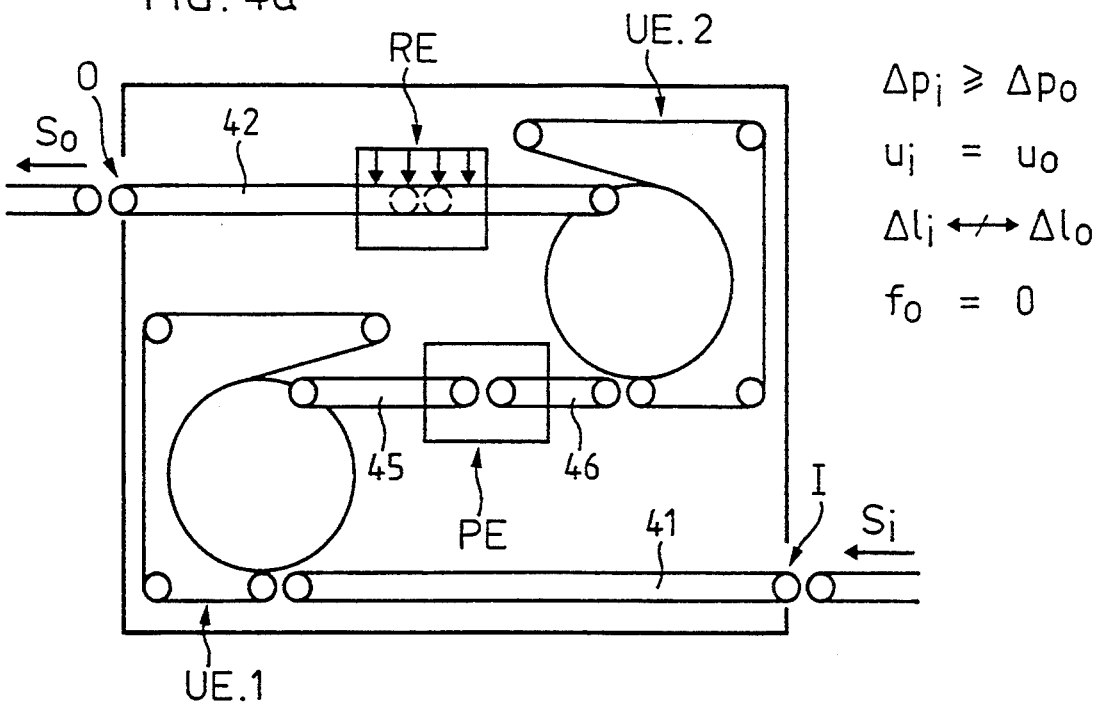
FIGS. 4*a* to 4*d* show functional diagrams of exemplary embodiments of the interface according to the invention.
Figure 4B:
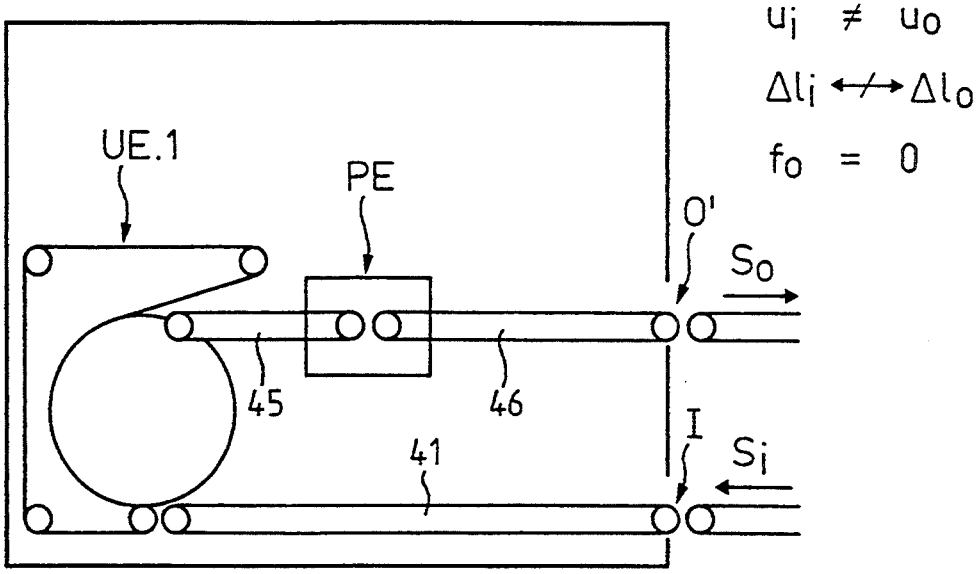
Figure 4C:
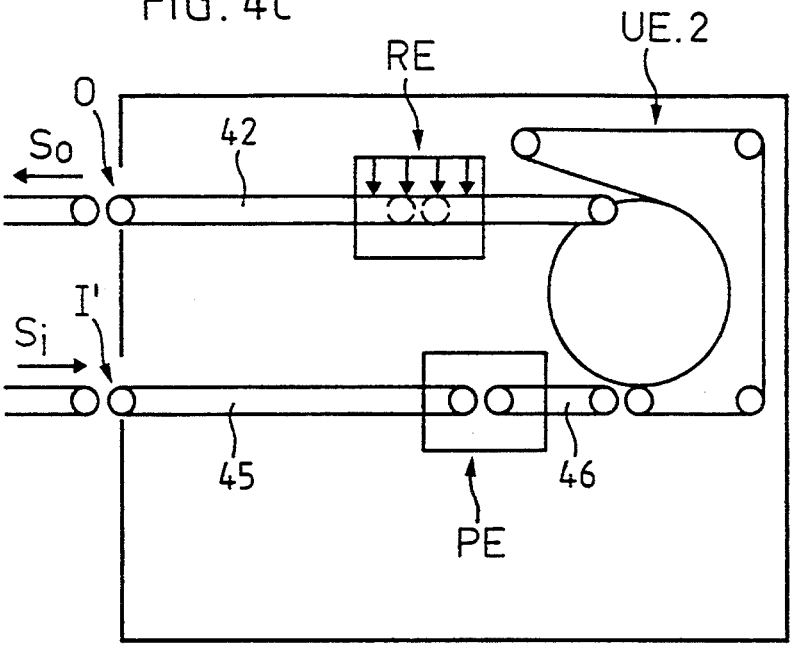

FIGS. 4*a* to 4*c* show, in the diagrammatic method of representation of FIGS. 3*a* to 3*d*, a number of exemplary embodiments of the interface according to the invention.

FIG. 4*a* shows an interface having two deflecting elements UE.1 and UE.2, a buffer element PE and a righting element RE, which may be designed with or without a transfer function. The serial sequence of the functional units is, according to the constructional principle: input I, UE.1, PE, UE.2, RE, output O. The interface works with four (or five) transporting belts, of which a first (input belt 41) takes over the printed products at the input I to the interface from a transporting means of the upstream imbricated stream-delivering apparatus, and a final (output belt 42) transfers the printed products to a transporting means of the downstream imbricated stream-receiving apparatus.

Both input belt 41 and output belt 42 assume additional functions. The input belt 41 passes the printed products for example into the first deflecting element UE.1, the output belt 42 passes the printed products out of the second deflecting element UE.2 through the righting element RE if the latter is functioning without transfer. Arranged between input belt 41 and output belt 42 are two further transporting belts 45 and 46, which both likewise have two different functions each. The transporting belt 45 is at the same time a carrying-away transporting belt of the first deflecting element UE.1 and a feeding transporting belt of the buffer element PE. The transporting belt 46 is at the same time a carrying-away transporting belt of the buffer element PE and a feeding transporting belt of the second deflecting element UE.2.

If the righting element RE is also a transfer element, a further transporting belt is necessary. The righting element is advantageously arranged directly upstream of the output O as the final functional element before the output, in order that the printed products cannot be displaced out of their aligned position again in any functional element following the righting element RE. For the same reason, it is also advantageously not envisaged that the transfer element of the interface output O is used for changing the stream parameters v, a or p.

The output stream $S_o$ flowing out from the interface according to FIG. 4*a* is uniformized vis-a-vis the input stream $S_i$ with respect to $\Delta p$. The two streams are isolated with respect to handling rate fluctuations $\Delta l$. The type of overlap u is the same (two deflections). The output stream $S_o$ has no gaps and (depending on the design of the buffer element PE) can be uniformized with respect to $\Delta a$. The stream parameters v and a can be changed, essentially in a way dependent on the relative speeds of the transporting belt of the upstream apparatus and of the transporting belt 42. The stream parameter p can be changed, depending on the arrangement of the transporting belts. The interface has a buffer element PE, which processes an imbricated stream, the stream parameter u (type of overlap) of which is different from the u of the in-running and out-running imbricated stream.

FIG. 4*b* shows a further exemplary embodiment of the interface according to the invention. It has a deflecting element UE.1, a buffer element PE and three transporting belts (41, 45, 46), each transporting belt forming the output of one functional element and the input of a following functional element. In this interface, the imbricated stream is isolated with respect to handling rate fluctuations $\Delta l$. The type of overlap u alters. The interface does not act on the stream parameter $\Delta p$. It may or may not act on the stream parameters v, a, p and $\Delta a$. The buffer element PE used handles an imbricated stream with the same type of overlap u which the output stream $S_o$ also has.

The interface according to FIG. 4*b* is also conceivable as a configuration of the interface according to FIG. 4*a*, in that the transporting belt 46 leads to a second output O′, which can be activated by configuration.

FIG. 4*c* shows a further type of design of the interface according to the invention, which differs from that according to FIG. 4*b* by a righting element RE and, as a result, acts in a uniformizing manner with respect to $\Delta p$. The buffer element PE used handles an imbricated stream with the same type of overlap u which the input stream $S_i$ also has. This type of design is also conceivable as a configuration of the embodiment according to FIG. 4*a* with two inputs I and I′.

Figure 4D:
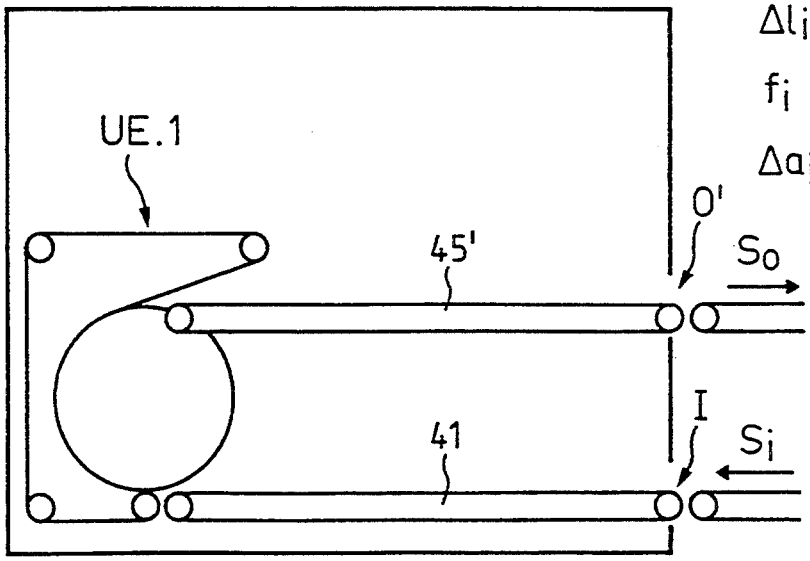

FIG. 4*d* shows a very simple embodiment of the interface according to the invention, which is likewise conceivable as a configuration of one of the embodiments represented before, by its buffer element not being active or being replaced by a transporting belt 45′ and the second output O′ being used. In this interface, only the stream parameter u is necessarily changed. It cannot act on the stream parameters $\Delta a$, $\Delta p$, f, $\Delta l$.

FIGS. 4*a* to 4*d* respectively show the path of an imbricated stream in the interface, said path being directed from bottom to top. It is also possible to operate the interfaces with a general conveying direction from top to bottom if the functional elements are correspondingly set up.

The function mentioned at the beginning of pressing the printed products can be assumed, for example, by a pressing roll arranged opposite one of the transporting belts of the interface, by the transverse conveying means of the righting element or by one of the deflecting elements.

Figure 5A:
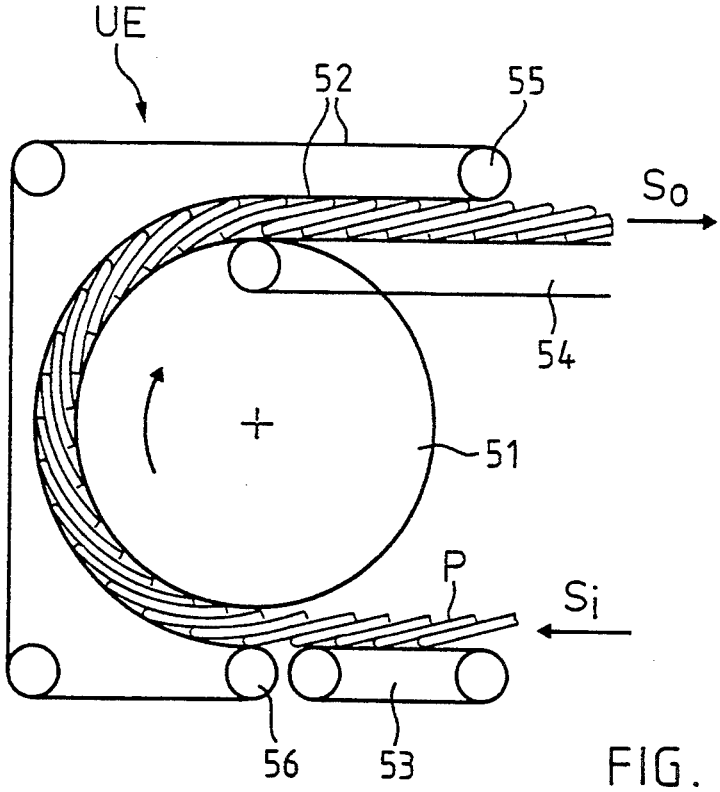
FIGS. 5*a* and *b* show an exemplary embodiment of the deflecting element as a side view and a plan view.
Figure 5B:
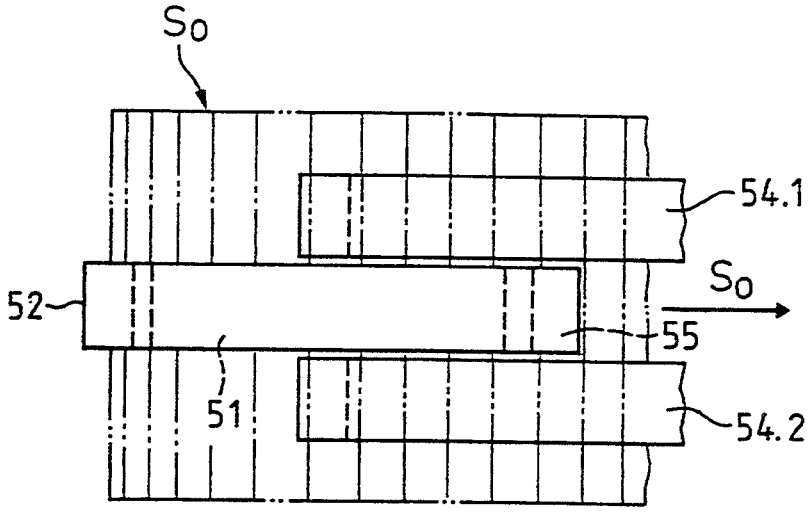

FIGS. 5*a* and *b* show an embodiment of the deflecting element UE which is advantageous for the interface according to the invention, as a side view, looking in the direction parallel to the axis of deflection (FIG. 5*a*), and as a plan view (FIG. 5*b*, without return sides of the belts). The deflecting element has a deflecting roller 51, a deflecting belt 52 and two transporting belts (53 and 54). The deflecting roller 51 and the deflecting belt 52 are significantly narrower than the printed products. This can be seen clearly in the plan view (FIG. 5*b*), in which the printed products running upward around the deflecting roller 51 and out from the deflecting point are indicated by dot-dashed lines. The two transporting belts 53 and 54 are designed as double belts and are arranged in the region of the transfer between deflecting roller 51 or deflecting belt 52 and transporting belt (54 or 53) on both sides of the deflecting roller. This can be seen clearly in FIG. 5*b* for the transporting belt 54, which has two part-belts 54.1 and 54.2. The printed products are sufficiently stable in the region of the deflection in spite of the small width of deflecting roller 51 and deflecting belt 52, since the deflecting radius is chosen to be so small that the printed products are stabilized by their curvature and, as a result, held firmly between deflecting roller 51 and deflecting belt 52, adopt a well-defined position over their entire widths.

The operation of the deflecting element may be reversed, as desired. Usually, the deflecting belt 52 is driven and the deflecting roller 51 is dragged. The drive of the deflecting belt 52, which runs around the deflecting roller 51, is arranged in such a way that the belt is drawn in the conveying direction around the deflecting roller, that is to say that, in the case of the conveying direction shown, for example a roller 55 is driven, in the reverse conveying direction a roller 56 is driven. The speed of the deflecting belt 52 is in this case greater than the speed of the transporting belt 54.

It goes without saying that deflecting elements which have a wider deflecting roller and a wider deflecting belt, which can also assume the function of a transporting belt, can also be used in the interface unit according to the invention. In this case, it is possible to use the deflecting point also for applying pressure to the printed products. Also conceivable are additional belts arranged parallel to the deflecting belt, for example for applying pressure to a laterally folded product.

Figure 6:
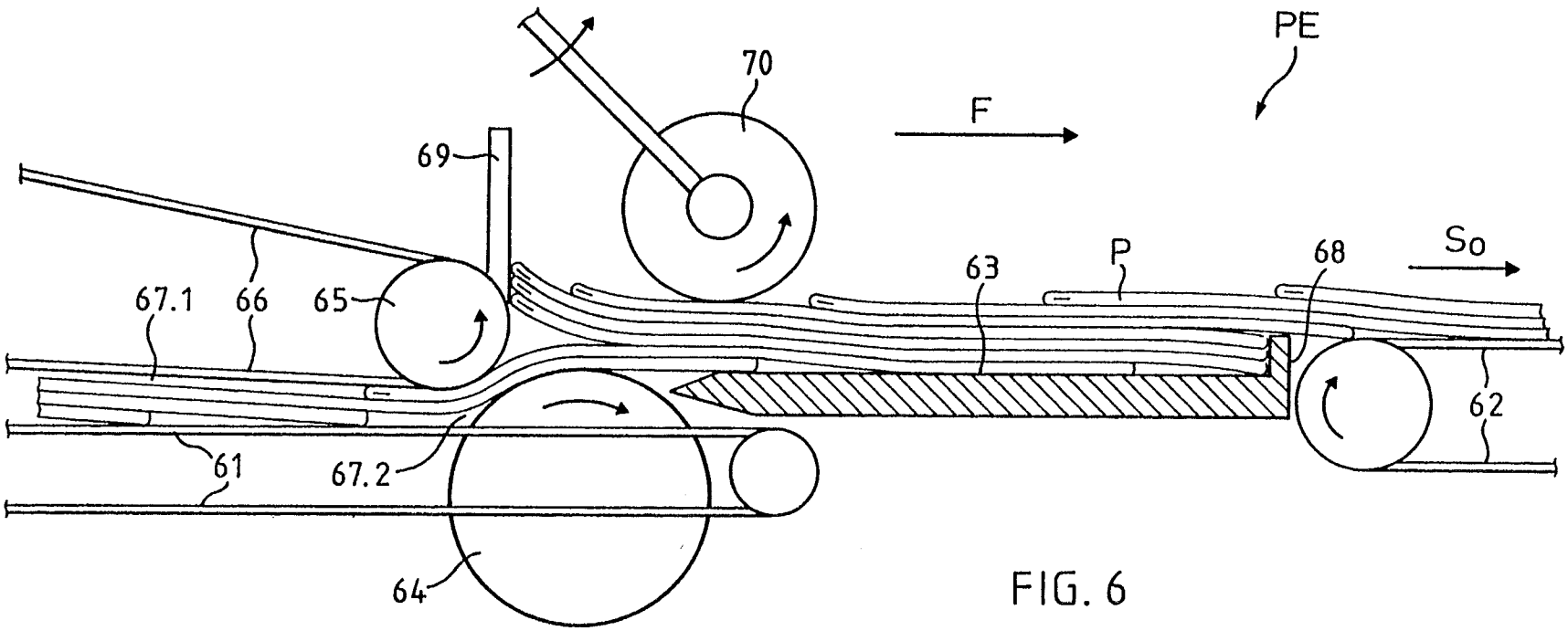
FIG. 6 shows an exemplary embodiment of the buffer element.

FIG. 6 shows an embodiment of a buffer element PE which is advantageous for the interface according to the invention, looking in the direction transversely to the conveying direction F. It is a buffer element with a stack between the two transporting belts. The buffer element shown is particularly advantageous for the apparatus according to the invention, because it can be realized in a very simple and compact form.

As already described, the buffer element has a run-in transporting belt 61 (shown only as a fragment) and a run-out transporting belt 62. In between there is a stationary rest 63. Run-in transporting belt 61, rest 63 and run-out transporting belt 62 are arranged in such a way that the resting surface for the printed products is raised in a step-shaped manner at the transition from one to the other. Between the run-in transporting belt 61 and the rest 63, a transporting roller 64 is arranged and driven in such a way that it takes over the printed products from the run-in transporting belt 61 and at the same time raises them slightly. Above the take-over point between run-in transporting belt 61 and transporting roller 64, a deflecting roller 65 for an auxiliary belt 66 is arranged and driven in such a way that the auxiliary belt 66 forms together with the run-in transporting belt 61 a conveying channel 67.1 which narrows toward the transporting roller 64 and, in the region of the transfer from run-in transporting belt 61 to transporting roller 64, opens out into a conveying nip 67.2, which has essentially a width corresponding to the thickness of the imbricated stream in-running. The printed products conveyed through the conveying nip 67.2 are raised onto the rest 63 and pushed under printed products already lying thereupon, until they butt against a stop 68. The stop 68 is arranged in such a way that a products butts against it when its trailing edge is just being conveyed through the conveying nip 67.2. The auxiliary belt 66, provided with an adhesive surface, raises this trailing edge of a printed product positioned against the stop 68 along the circumference of the deflecting roller 65 as far as a second stop 69, whereby trailing edges of printed products already resting on the rest 63 are raised up further along the stop 69. By continuous pushing in of printed products through the conveying nip 67.2, a stack is produced between the stops 68 and 69. In this way, gaps in the in-running imbricated stream are closed and the timing of its rate is ended.

Instead of an auxiliary belt 66 provided with an adhesive surface, said belt may also be finished like a normal transporting belt, but narrower than the printed products and narrower than the deflecting roller 65. Those parts of the deflecting roller 65 which are not covered by the auxiliary belt 66, and consequently come into contact with the printed products, in this case bear an adhesive surface. The printed products are then conveyed by the roller 65 to the stop 69.

Above the stack which rests on the rest 63, a removing roller 70 is arranged and driven in such a way that it rests on the stack and conveys the respectively uppermost printed product of the stack from the stack onto the run-out transporting belt 62, which further conveys the imbricated stream $S_o$ produced by the removing roller 70.

The removing roller 70 can only convey away printed products of which the leading edges lie above the level of the stop 68. Stop 68 essentially has the task of stopping printed products pushed under the stack and of preventing the stack being displaced by the pushing under of new printed products in conveying direction F. In order to be able to perform this task, it must have a height which is greater than the thickness of a printed product. In other words, this means that the stack must at every moment have a minimum of printed products, namely as many as are needed to achieve a stack height which is greater than the height of the stop 68.

The further the removing roller 70 is arranged toward the run-out transporting belt 62, the longer it drives a printed product to be removed, that is to say the greater the product spacings of the imbricated stream produced (at the same speed of the removing roller). To prevent slipping between the roller and the printed product to be pushed away, the removing roller 70 may be provided with an adhesive surface or with openings, through which air is extracted in such a way that the printed product to be pushed is sucked against the removing roller and firmly held as a result. The less slipping there is between the removing roller and the product to be pushed, the higher the quality of the imbricated stream produced, with respect to irregularities in the product spacing (synchronization).

The imbricated stream $S_i$ running into the buffer element described must have downward-lying leading edges. The stack is created from the bottom and is removed from the top. The imbricated stream $S_o$ running out from the buffer element likewise has downward-lying leading edges. The quality of the imbricated stream $S_o$ produced, with respect to synchronization, is independent of the quality of the in-running stream $S_i$.

Instead of the stop 68, at least two vertically arranged, driven worm screws which have a corresponding height as specified for the stop 68 may be provided. The leading edge of a printed product pushed under the stack is then pushed into a turn in each case of the worm screws and raised by their turning movement until it reaches the upper end of the worm screws and, as a result, the printed product becomes part of the stack, which can be removed by the removing roller.

If the requirements with respect to synchronization of the imbricated stream produced are very high, the stack of the buffer element described may also be removed by a feeder function. Apparatuses which perform a feeder function are known and described, for example, in American U.S. Pat. No. 5,042,792 or European Laid-Open Application EP 0368009 of the same applicant. With a feeder function, the imbrication spacing a of the imbricated stream produced is uniformized to such an extent, that is to say $\Delta a$ becomes so small, that the imbricated stream meets all the requirements. However, then the buffer element is no longer very simple.

A further possibility of producing imbricated streams for higher requirements with respect to uniformity of the imbrication spacing ($\Delta a$) is to use buffer elements which have displacing means for displacing the transfer point between run-in transporting belt and run-out transporting belt. As already mentioned, such buffer elements are known. The advantage of such buffer elements is that the timing of the in-running imbricated stream is not ended, but simply changed. From a regular imbricated stream, in this way again a regular imbricated stream is produced. Such buffer elements process imbricated streams with upward-lying leading edges.

FIGS. *7a* and *b* show an embodiment of a righting element RE which is advantageous for the interface according to the invention, as a plan view (FIG. *7a*) and as a side view, looking in the direction transversely to the conveying direction (FIG. *7b*). The righting element essentially comprises a transporting belt 71, which passes an imbricated stream in conveying direction F through the righting element, a transverse conveying means (not shown) for displacing the printed products transversely to the conveying direction F, and a stop unit 72. It is a one-sided righting element, the printed products being displaced transversely to the conveying direction in only one direction against only one stop unit. The printed products are conveyed with a conveying direction $F_i$ into the righting element, where they are additionally conveyed transversely to the main conveying direction F, so that a conveying direction $F_r$ is produced and are finally conveyed with a conveying direction $F_o$ out of the righting element, the latter conveying direction running parallel to the conveying direction $F_i$. In the region of the conveyance in direction $F_r$, there is arranged laterally of the imbricated stream, at a distance x from it which is at least as great as a maximum expected deviation $\Delta p$ from the position p of the in-running imbricated stream a stop unit 72 which extends parallel to the in-running imbricated stream. The printed products are moved by the transverse conveying means against the stop 72 and aligned at the latter. They leave the righting element in a uniformized manner with respect to $\Delta p$ and with a position $p_o \cong p_i + x$.

Since the regularity of an imbricated stream with respect to $\Delta p$ is worsened with every further handling, it is advantageous to arrange the righting element directly upstream of the output of the interface and to set up the stream parameters a and p (taking x into account) at as early a point as at the output from the functional element which is arranged upstream of the righting element, in such a way that they meet the requirements of the apparatuses downstream from the righting element. In this manner, the righted imbricated stream no longer has to be manipulated before further processing.

As transverse conveying means of the righting element, use may be made of known transverse conveying means, such as for example conveying rollers or conveyor belts directed at an angle to the conveying direction or a stop arranged at an angle to the conveying direction.

As stop unit 72, use is made advantageously of a series of righting columns 73.1 to 73.6. The righting columns have a round outline and are arranged in the region of the transverse conveying means in a series parallel to the conveying directions $F_1$ and $F_o$ at a distance x from the side edge of the in-running imbricated stream and are driven in such a way that their surface directed toward the imbricated stream moves at the speed of the stream in the conveying direction F. The surface of the righting columns is advantageously rough, for example cross-knurled, in order that the printed products do not slide thereupon, but are moved along with them. The drive of the righting columns may, for example, be realized by a drive belt 74, which is arranged underneath or above the transporting belt 71 and, for deflection about the righting columns 73.1 to 73.6, is led for example around deflecting rollers 75.1 to 75.5 arranged between the righting columns.

In order to prevent printed products which are conveyed for example with one corner toward a distance between two righting columns being carried through between the righting columns and under the conveying means, which could take them out of the stream and damage them, stop plates 76 are advantageously provided between the righting columns. These stop plates are angled off and extend under the transporting belt 71.

I claim:

1. An interface for imbricated formations of printed products for use between a delivering apparatus (2) delivering an imbricated stream and a processing apparatus (3) processing an imbricated stream, with an input (I) for in-running imbricated stream ($S_i$) of printed products delivered from the delivering apparatus (2) and an output (O) for an out-running imbricated stream ($S_o$) of printed products to be infed to the processing apparatus (3) and comprising a plurality of functional elements each for changing one or more of the stream parameters ($v,a,p,u,\Delta a,\Delta p,\Delta l,f$) while maintaining an imbricated arrangement of the products as the stream passes through each of the elements, said plurality of functional elements being positioned in a series between said input (I) and said output (O) and including at least one deflecting element (UE) for changing the type of overlap (u) of the products in an imbricated stream and at least two other functional elements (PE, RE), wherein said one deflecting element is arranged between said two other functional elements, and further comprising a transport belt running between each adjacent pair of functional elements and so that each transport belt serves both as an out-running transport for one functional element and an in-running transport for another functional element.

2. The interface as defined in claim 1 wherein said plurality of functional elements includes a buffer element for changing the distance (a) between neighboring products in the stream.

3. The interface as defined in claim 1 wherein said plurality of functional elements includes a righting element for adjusting the position (p) of the products within the imbricated stream.

4. The interface as claimed in claim 3, wherein said righting element (RE) is arranged directly upstream of said output (O).

5. The interface as claimed in claim 3, wherein said plurality of functional elements comprises a second deflecting element (UE1, UE2), a buffer element (PE) arranged between the two deflecting elements (UE1, UE2), said righting element (RE) being arranged between the second deflecting element (UE2) and the output (O).

6. The method of operating the interface as defined in claim 1 comprising the steps of setting the stream parameters speed (v), product spacing (a) and product position (p) for the first functional element at the input (I) upon transfer of the in-running imbricated stream ($S_i$) into the interface and setting these stream parameters (v, a, p) for the next functional element.

7. The method as defined in claim 6, wherein the stream parameters speed (v), product spacing (a) and product position (p) are set in the final or in the two final functional elements for the imbricated stream (So) running out from the interface, so that they do not have to be changed upon transfer at the output (O).

8. The method as defined in claim 6, wherein the imbricated stream is uniformized with respect to lateral alignment in the final functional element before the output (O).

9. An interface for imbricated formations of printed products for use between a delivering apparatus (2) delivering an imbricated stream and a processing apparatus (3) processing an imbricated stream, with an input (I) for an in-running imbricated stream ($S_i$) of printed products delivered from the delivering apparatus (2) and an output (O) for an out-running imbricated stream ($S_o$) of printed products to be infed to the processing apparatus (3) and comprising at least two functional elements each for changing one or more of the stream parameters (v,a,p,u,Δa,Δp,Δl,f) while maintaining an imbricated arrangement of the products as the stream passes through each of the elements, said plurality of functional elements being positioned in series between said input (I) and said output (O) and including at least one deflecting element (UE) for changing the type of overlap (u) of the products in an imbricated stream and at least one other functional element (PE, RE), and further comprising a transport belt running between said one deflecting element and said one other functional element and so that said transport belt serves both as an out-running transport for one functional element and an in-running transport for another functional element.

* * * * *